US006365889B1

(12) United States Patent
Elgee

(10) Patent No.: US 6,365,889 B1
(45) Date of Patent: Apr. 2, 2002

(54) PRINT MEDIA DETECTOR AND METHOD FOR USE IN A PRINTING DEVICE

(75) Inventor: Steven B. Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/256,974

(22) Filed: Feb. 24, 1999

(51) Int. Cl.[7] ..... H01J 40/14
(52) U.S. Cl. ..... 250/221; 347/14
(58) Field of Search ..... 250/221; 347/101, 347/102, 14

(56) References Cited

U.S. PATENT DOCUMENTS

| | | | | |
|---|---|---|---|---|
| 4,340,663 A | | 7/1982 | Mikawa et al. | 430/496 |
| 4,503,323 A | | 3/1985 | Flam | 235/489 |
| 4,641,019 A | | 2/1987 | Inatsuki | 250/201 |
| 4,734,868 A | | 3/1988 | DeLacy | 364/519 |
| 4,865,478 A | | 9/1989 | Chan et al. | 400/616.3 |
| 4,916,638 A | | 4/1990 | Haselby et al. | 364/519 |
| 5,139,339 A | | 8/1992 | Courtney et al. | 356/446 |
| 5,252,991 A | | 10/1993 | Storlie et al. | 346/108 |
| 5,323,176 A | * | 6/1994 | Sugiura et al. | 346/25 |
| 5,444,469 A | | 8/1995 | Cowger | 347/14 |
| 5,568,172 A | | 10/1996 | Cowger | 347/19 |

* cited by examiner

*Primary Examiner*—F. L Evans
(74) *Attorney, Agent, or Firm*—Erik A. Anderson

(57) ABSTRACT

A print media detection system for use in a printing device is disclosed. An embodiment of the print media detection system includes a source configured to transmit a light signal and a sensor configured to detect the light signal and generate an electrical signal in response to the light signal, the electrical signal having a magnitude that increases up to a substantially constant value as an intensity of the light signal from the source increases. The sensor is also configured to generate the electrical signal with a first magnitude for a transparent print media through which the light signal from the source travels to the sensor. The sensor is further configured to generate the electrical signal with a second magnitude less than the first magnitude for nontransparent print media positioned in a path of the light signal from the source to the sensor. A printing device including the print media detection system is also disclosed. A method of detecting transparent and nontransparent print media for use in a printing device is additionally disclosed. Further characteristics and features of the print media detection system, printing device, and method are described herein, as are examples of various alternative embodiments.

7 Claims, 5 Drawing Sheets

PRINT MEDIA DETECTOR AND METHOD FOR USE IN A PRINTING DEVICE

BACKGROUND AND SUMMARY

The present invention relates to printing devices. More particularly, the present invention relates to a media detector for and a method of differentiating between transparent and nontransparent print media.

Printing devices, such as inkjet printers, use printing composition (e.g., ink or toner) to print text, graphics, images, etc. onto print media. The print media may be of any of a variety of different types including transparencies, standard document paper, letter quality paper, envelopes, photographic print stock, cloth, etc. These print media may be placed in one of two broad categories relating to the amount of light that is transmitted through the particular print media. The first category is transparent print media, such as overhead transparencies that are used with an overhead projector and screen. The second category is nontransparent print media, such as standard document paper, letter quality paper, envelopes, photographic print stock, cloth, etc. A transparent print media is specifically defined herein as having the property of transmitting visually perceptible light signals through such media substantially unattenuated when the visually perceptible light signals are substantially orthogonally incident to either surface of such print media. A nontransparent print media is specifically defined herein as having the property of substantially diffusing and attenuating visually perceptible light signals incident to either surface of such print media. Transparent and nontransparent print media each have various characteristics that ideally should be accounted for during printing, otherwise a less than optimal printed output may occur.

One way in which a printing device can be configured to a particular print medium is to have a user make manual adjustments to the printing device based upon these characteristics and factors. One problem with this approach is that it requires user intervention which is undesirable. Another problem with this approach is that it requires a user to correctly identify various characteristics of a particular print medium. A further problem with this approach is that a user may choose not to manually configure the printing device or may incorrectly manually configure the printing device so that optimal printing still does not occur in spite of user intervention. This can be time-consuming and expensive depending on when the configuration error is detected and the cost of the particular print medium.

A device and method that automatically differentiates between transparent and nontransparent print media would be a welcome improvement. Accordingly, the present invention is directed to alleviating these above-described problems and achieving this end. The present invention accomplishes this without degrading output print quality of the printing device.

An embodiment of a print media detection system in accordance with the present invention for use in a printing device includes a source and a sensor. The source is configured to transmit a light signal and the sensor is configured to detect the light signal and generate an electrical signal in response to the light signal. The electrical signal has a magnitude that increases up to a substantially constant value as an intensity of the light signal from the source increases. The sensor is also configured to generate the electrical signal with a first magnitude for a transparent print media through which the light signal from the source travels to the sensor.

The sensor is additionally configured to generate the electrical signal with a second magnitude less than the first magnitude for nontransparent print media positioned in a path of the light signal from the source to the sensor.

The above-described print media detection system in accordance with the present invention may be modified and include the following characteristics described below. The print media detection system may further include a controller coupled to the sensor. The controller is configured to receive the electrical signal from the sensor and, based at least in part on the electrical signal, control an operating parameter of the printing device.

The source may include a focused light emitting diode. The sensor may include a phototransistor. The print media detection system may be used in a printing device.

An alternative embodiment of a print media detection system in accordance with the present invention for use in a printing device includes structure for transmitting a light signal. The print media detection system also includes structure for sensing the light signal and producing an electrical signal having a first magnitude for a transparent print media through which the light signal travels and a second magnitude less than the first magnitude for nontransparent print media positioned in a path of the light signal from the source to the sensor.

The above-described alternative embodiment of a print media detection system in accordance with the present invention may be modified and include the following characteristics described below. The print media detection system may further include structure, coupled to the structure for sensing, for controlling an operating parameter of the printing device based at least in part on the electrical signal received from the means from sensing.

The structure for transmitting may include a focused light emitting diode. The structure for sensing may include a phototransistor. The print media detection system may be used in a printing device.

An embodiment of a method of detecting transparent and nontransparent print media in accordance with the present invention for use in a printing device includes transmitting a light signal toward a sheet of print media. The method also includes measuring an intensity of light at a sensor positioned along a path of the light signal, the sheet of print media being positioned between the light signal and the sensor. The method further includes generating either an electrical signal having a first magnitude for a measured intensity of light substantially equal to an intensity of the light signal or an electrical signal having a second magnitude less than the first magnitude for a measured intensity of light less than the intensity of the light signal.

The above-described method in accordance with the present invention may be modified and include the following characteristics described below. The method may further include controlling an operating parameter of the printing device based at least in part on the electrical signal.

Other objects, advantages, and novel features of the present invention will become apparent from the following detailed description of the invention when considered in conjunction with the accompanying drawings.

DETAILED DESCRIPTION OF THE DRAWINGS

Figure 1:
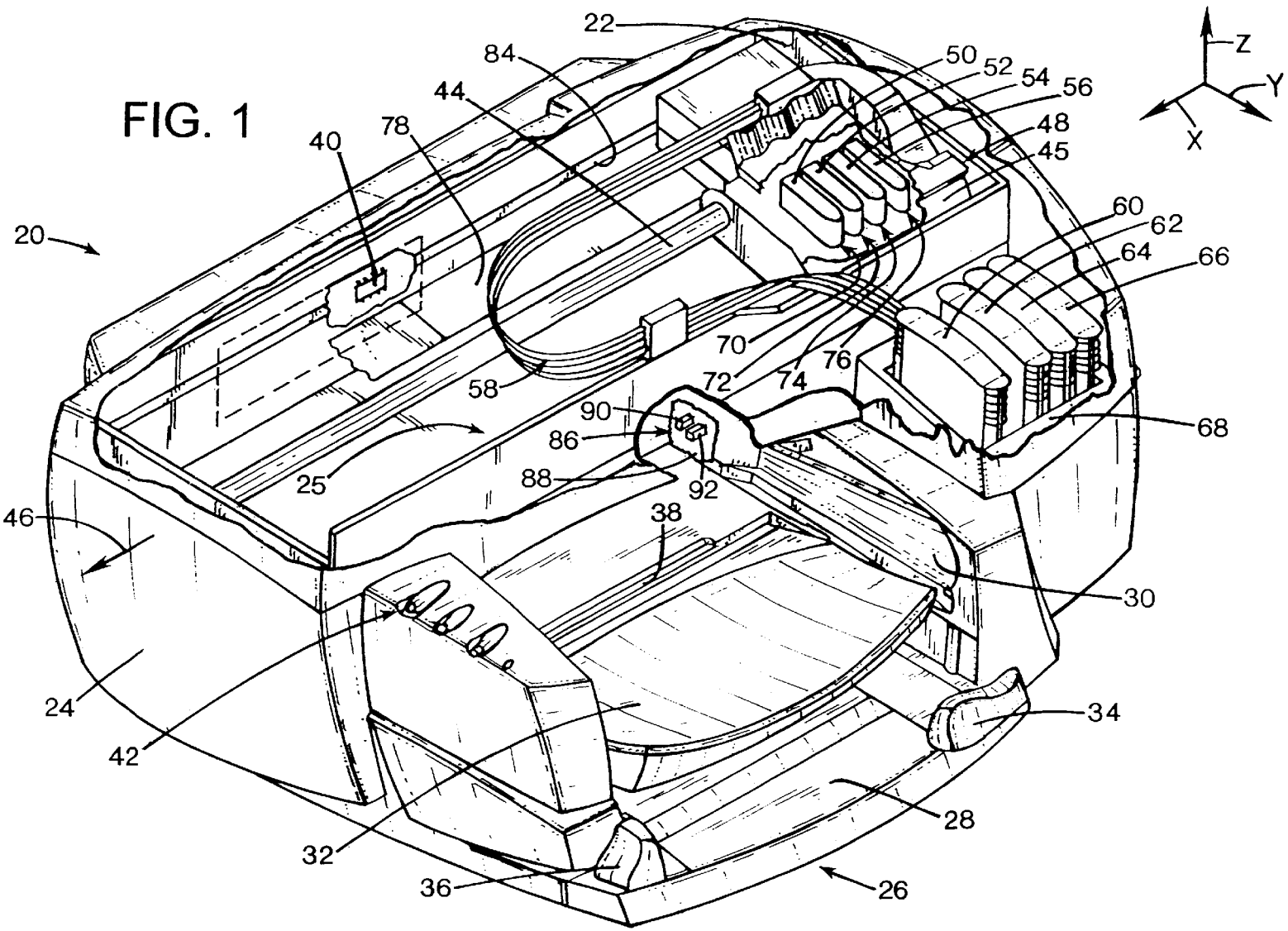
FIG. 1 is a front perspective view of a printing device that includes an embodiment of the present invention.

FIG. 1 illustrates an embodiment of an inkjet printing device 20, here shown as an "off-axis" inkjet printer, constructed in accordance with the present invention, which may be used for printing business reports, correspondence, desktop publishing, and the like, in an industrial, office, home or other environment. A variety of inkjet printing devices are commercially available. For instance, some of the printing devices that may embody the present invention include plotters, portable printing units, copiers, cameras, video printers, and facsimile machines, to name a few, as well as various combination devices, such as a combination facsimile and printer. For convenience, the concepts of the present invention are illustrated in the environment of inkjet printer 20.

While it is apparent that the printing device components may vary from model to model, the typical inkjet printer 20 includes a frame or chassis 22 surrounded by a housing, casing or enclosure 24, typically made of a plastic material. Sheets of print media are fed through a printzone 25 by a print media handling system 26. The print media may be any type of suitable material, such as paper, card-stock, transparencies, photographic paper, fabric, metalized media, and the like. Print media handling system 26 has an input supply feed tray 28 for storing sheets of print media before printing. A series of conventional print media drive rollers (not shown in FIG. 1) driven by a direct current (dc) motor and drive gear assembly (not shown) may be used to move the print media from feed tray 28, through the printzone 25, and, after printing, onto a pair of extended output drying wing members 30, shown in a retracted or rest position in FIG. 1. Wings 30 momentarily hold a newly printed sheet of print media above any previously printed sheets still drying in an output tray portion 32, then wings 30 retract to the sides to drop the newly printed sheet into the output tray 32. Print media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38. Although not shown, it is to be understood that print media handling system 26 may also include other items such as one or more additional print media feed trays. Additionally, media handling system 26 and printing device 20 may be configured to support specific printing tasks such as duplex printing and banner printing.

Printing device 20 also has a printer controller 40, illustrated schematically as a microprocessor, that receives instructions from a host device, typically a computer, such as a personal computer (not shown). Many of the printer controller functions may be performed by the host computer, including any printing device drivers resident on the host computer, by electronics on board the printer, or by interactions between the host computer and the electronics. As used herein, the term "printer controller 40" encompasses these functions, whether performed by the host computer, the printer, an intermediary device between the host computer and printer, or by combined interaction of such elements. Printer controller 40 may also operate in response to user inputs provided through a key pad 42 located on the exterior of the casing 24. A monitor (not shown) coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by chassis 22 to slidably support an off-axis inkjet pen carriage system 45 for travel back and forth across printzone 25 along a scanning axis 46. As can be seen in FIG. 1, scanning axis 46 is substantially parallel to the X-axis of the XYZ coordinate system shown in FIG. 1. It should be noted that the use of the word substantially in this document is used to account for things such as engineering and manufacturing tolerances, as well as variations not affecting performance of the present invention.

Carriage 45 is also propelled along guide rod 44 into a servicing region, as indicated generally by arrow 48, located within the interior of housing 24. A conventional carriage drive gear and dc (direct current) motor assembly (both of which are not shown) may be coupled to drive an endless loop, which may be secured in a conventional manner to carriage 45, with the dc motor operating in response to control signals received from controller 40 to incrementally advance carriage 45 along guide rod 44 in response to rotation of the dc motor.

In printzone 25, the media sheet receives ink from an inkjet cartridge, such as a black ink cartridge 50 and three monochrome color ink cartridges 52, 54, and 56. Cartridges 50, 52, 54, and 56 are also often called "pens" by those in the art. Pens 50, 52, 54, and 56 each include small reservoirs for storing a supply of ink in what is known as an "off-axis" ink delivery system, which is in contrast to a replaceable ink cartridge system where each pen has a reservoir that carries the entire ink supply as the printhead reciprocates over printzone 25 along the scan axis 46. The replaceable ink cartridge system may be considered as an "on-axis" system, whereas systems which store the main ink supply at a stationary location remote from the printzone scanning axis are called "off-axis" systems. It should be noted that the present invention is operable in both off-axis and on-axis systems.

In the illustrated off-axis printer 20, ink of each color for each printhead is delivered via a conduit or tubing system 58 from a group of main ink reservoirs 60, 62, 64, and 66 to the on-board reservoirs of respective pens 50, 52, 54, and 56. Stationary ink reservoirs 60, 62, 64, and 66 are replaceable ink supplies stored in a receptacle 68 supported by printer chassis 22. Each of pens 50, 52, 54, and 56 has a respective printhead, as generally indicated by arrows 70, 72, 74, and 76, which selectively ejects ink to from an image on a sheet of print media in printzone 25.

Printheads 70, 72, 74, and 76 each have an orifice plate with a plurality of nozzles formed therethrough in a manner well known to those skilled in the art. The illustrated printheads 70, 72, 74, and 76 are thermal inkjet printheads, although other types of printheads may be used, such as piezoelectric printheads. Thermal printheads 70, 72, 74, and 76 typically include a plurality of resistors which are associated with the nozzles. Upon energizing a selected resistor, a bubble of gas is formed which ejects a droplet of ink from the nozzle onto a sheet of print media in printzone 25 under the nozzle. The printhead resistors are selectively energized in response to firing command control signals delivered by a multi-conductor strip 78 (a portion of which is shown in FIG. 1) from the controller 40 to printhead carriage 45.

To provide carriage positional feedback information to printer controller 40, a conventional optical encoder strip 84 extends along the length of the printzone 25 and over the service station area 48, with a conventional optical encoder reader being mounted on a back surface of printhead carriage 45 to read positional information provided by encoder strip 84. Printer 20 uses optical encoder strip 84 and optical encoder reader (not shown) to trigger the firing of printheads 70, 72, 74, and 76, as well as to provide feedback for position and velocity of carriage 45. Optical encoder strip 84 may be made from things such as photo imaged MYLAR brand film, and works with a light source and a light detector (both of which are not shown) of the optical encoder reader. The light source directs light through strip 84 which is received by the light detector and converted into an electrical signal which is used by controller 40 of printing device 20 to control firing of printheads 70, 72, 74, and 76, as well as carriage 45 position and velocity. Markings or indicia on encoder strip 84 periodically block this light from the light detector in a predetermined manner which results in a corresponding change in the electrical signal from the detector. The manner of providing positional feedback information via optical encoder reader may be accomplished in a variety of different ways known to those skilled in the art.

An embodiment of a print media detector 86 constructed in accordance with the present invention is attached to sidewall 88 of print media handling system 26. As discussed more fully below, print media detector 86 is positioned in or adjacent the print media path to determine whether a print medium is transparent or nontransparent prior to printing on the print medium by pens 70, 72, 74, and 76. A transparent print media is specifically defined herein as having the property of transmitting visually perceptible light signals through such media substantially unattenuated when the visually perceptible light signals are substantially orthogonally incident to either surface of such print media. A nontransparent print media is specifically defined herein as having the property of substantially diffusing and attenuating visually perceptible light signals incident to either surface of such print media.

As can be seen in FIG. 1, print media detector 86 includes a source 90 configured to transmit a light signal and a sensor 92 configured to detect the light signal from source 90 and convert the light signal into an electrical signal. Sensor 92 is coupled to controller 40 and controller 40 is configured to receive the electrical signal from sensor 92 and, based at least in part on this electrical signal, control one or more operating parameters of printing device 20.

Figure 2:
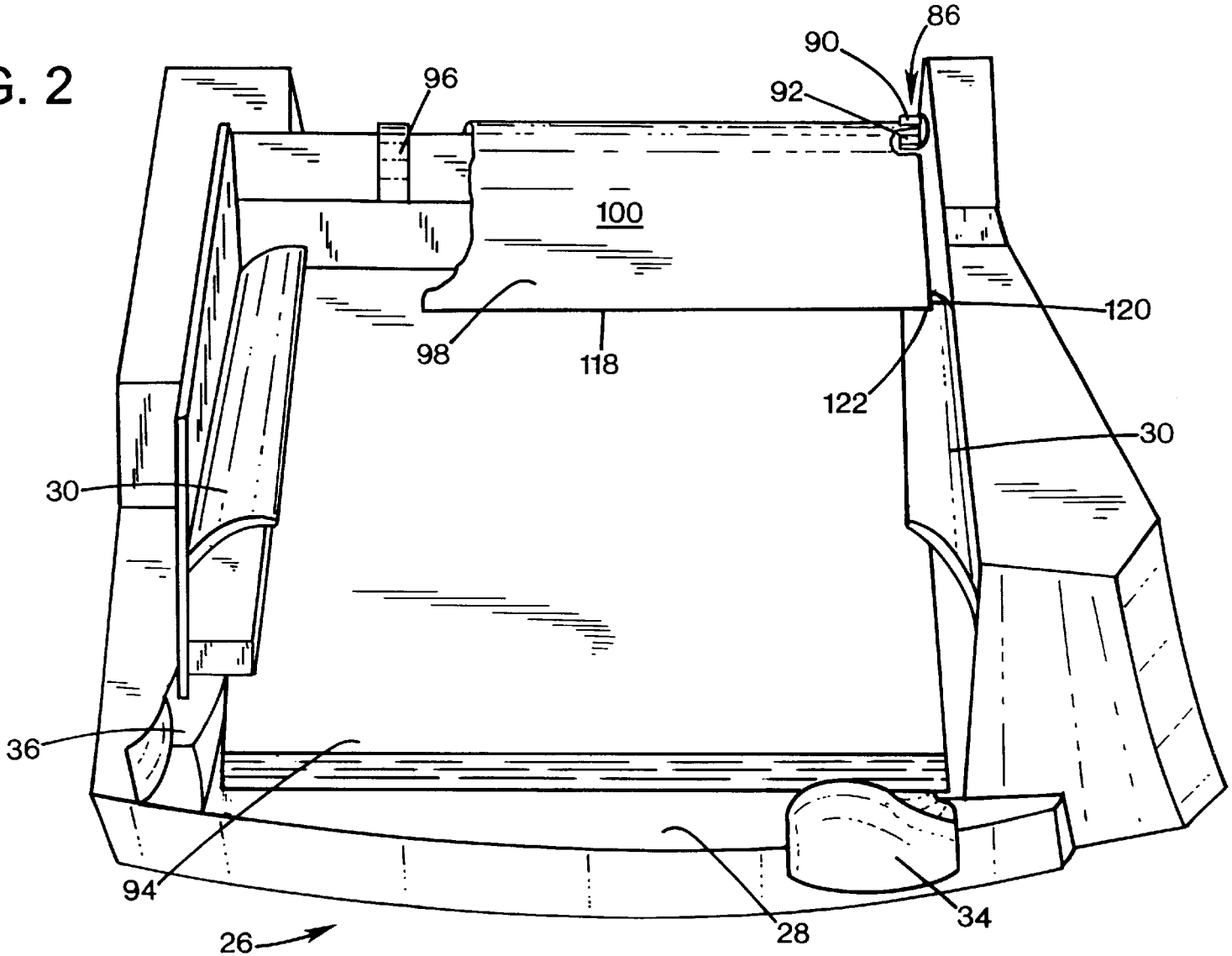
FIG. 2 is a front, top view of a print media handing system of the printing device shown in FIG.1 and an embodiment of a print media detector of the present invention.
Figure 3:
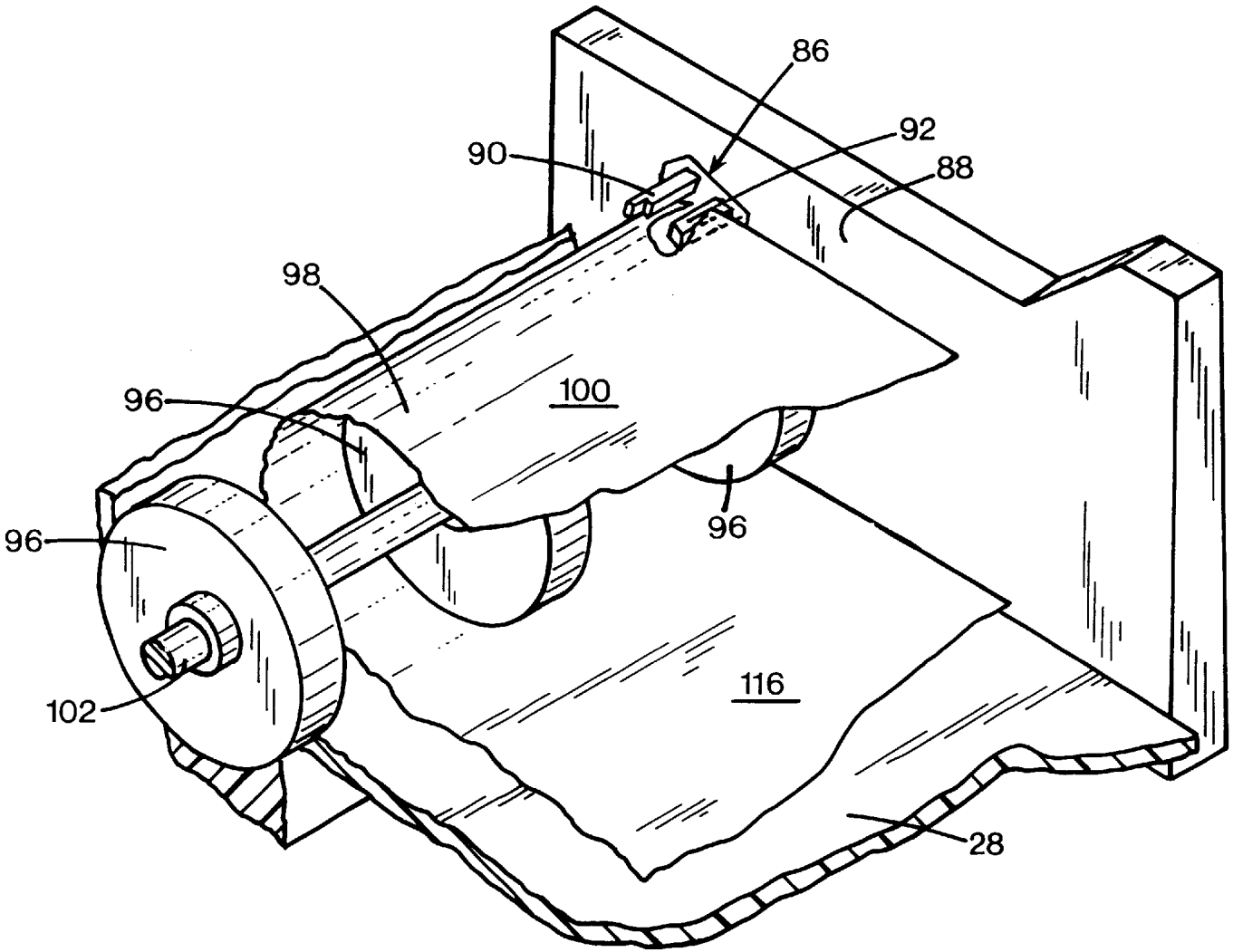
FIG. 3 is a front perspective view of the print media handling system and print media detector shown in FIG. 2.

A front, top perspective view of print media handing system 26 of printing device 20 and print media detector 86 are shown in FIG. 2. A stack of print media 94 is loaded in input supply feed tray 28 and aligned via sliding length adjustment lever 34 and sliding width adjustment lever 36. Print media feed rollers 96, only one of which is shown, are designed to select a single sheet of print media 98 from stack 94 and transport sheet 98 to printzone 25 for printing on first surface 100 of the substrate of sheet 98 by one or more of pens 50, 52, 54, and 56. This is know as "picking" by those skilled in the art. Print media feed rollers 96 are mounted on a shaft 102 (see s FIG. 3) which is driven by motor (not shown). This motor is controlled by printer controller 40. As can be seen in FIG. 2, output drying wing members 30 support print media sheet 98 as it travels through printzone 25 during printing, as well as subsequent to printing to allow for drying, as discussed above.

Print media 98 may be of any of a variety of different types including transparencies, standard document paper, letter quality paper, envelopes, photographic print stock, cloth, etc. These various types of print media may be placed in one of two broad categories relating to amount of light that is transmitted through the particular print media. The first category is transparent print media, such as overhead transparencies that are used with an overhead projector and screen. The second category is nontransparent print media, such as such as standard document paper, letter quality paper, envelopes, photographic print stock, cloth, etc. Transparent and nontransparent print media each have various characteristics that ideally should be accounted for during printing, otherwise a less than optimal printed output may occur.

One way in which a printing device can be configured to a particular print medium is to have a user make manual adjustments to the printing device based upon these characteristics and factors. One problem with this approach is that it requires user intervention which is undesirable. Another problem with this approach is that it requires a user to correctly identify various characteristics of a particular print medium. A further problem with this approach is that a user may choose not to manually configure the printing device or may incorrectly manually configure the printing device so that optimal printing still does not occur in spite of user intervention. This can be time-consuming and expensive depending on when the configuration error is detected and the cost of the particular print medium.

A device and method that automatically differentiates between transparent and nontransparent print media would be a welcome improvement. Accordingly, the present invention is directed to alleviating these above-described problems and achieving this end. The present invention accomplishes this without degrading output print quality of the printing device.

Figure 4:
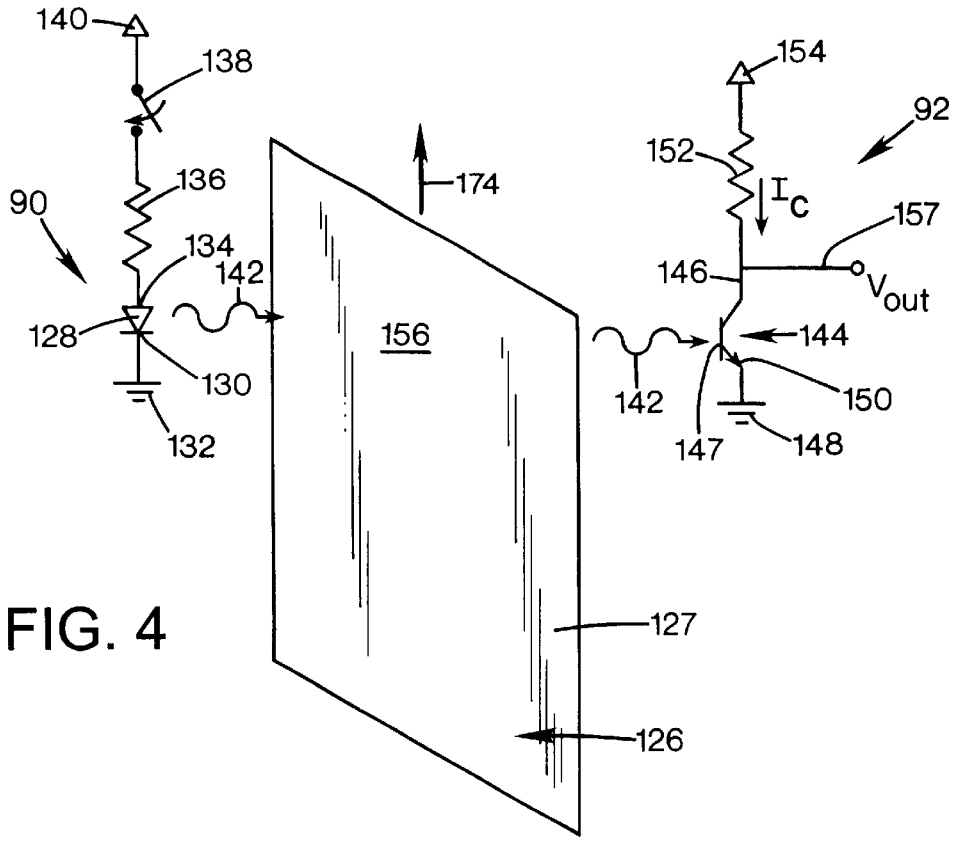
FIG. 4 is a schematic diagram of a print media detector of the present invention in use with a sheet of transparent print media.

A schematic diagram of source 90 and sensor 92 of print media detector 86 in use with a sheet of transparent print media 126 is shown in FIG. 4. As can be seen in FIG. 4, source 90 includes a light emitting diode (LED) 128 having a cathode 130 electrically connected to ground 132 and an anode 134 electrically connected to a current limiting resistor 136. Current limiting resistor 136 is also electrically connected to a switch 138 that is electrically connected to a power source 140. When switch 138 is closed, as, for example, when a sheet of print media is "picked" by print media feed rollers 96, power is supplied to LED 128 via power source 140 to produce a light signal 142. When switch 138 is open, no power is supplied to LED 128 and, as a consequence, no light signal is produced. Switch 138 is configured to be normally open so no light signal is produced. Switch 138 may be closed during "picking" of a sheet of print media by, for example, controller 40. Alternatively, switch 138 may be positioned in input supply feed tray so that it closes during "picking" by physical contact between switch 138 and the "picked" sheet of print media.

As can also be seen in FIG. 4, sensor 92 includes a phototransistor 144 having a collector 146 electrically connected to pull-up resistor 152 (having a resistance $R_{PULL-UP}$), a base 147, and an emitter 150 electrically connected to ground 148. Pull-up resistor 152 is also electrically connected to power source 154 having a voltage ($V_{SOURCE}$). Although a different power source 154 is shown for sensor 92 than for source 90, it is to be understood that in other embodiments of the present invention, source 90 and sensor 92 may use the same power source. Collector 146 of phototransistor 144 is also electrically connected to printer controller 40 via terminal 157.

Phototransistor 144 is configured to conduct current to ground 148 through pull-up resistor 152, generally represented as a current $I_C$, as light signal 142 illuminates base 147. This current $I_C$ produces an electrical signal at terminal 157, generally represented as a voltage $V_{OUT}$, that is received by printer controller 40. The resistance of phototransistor 144 is configured to decrease to a substantially constant minimum value as the magnitude of light illuminating it increases. As the resistance of phototransistor 144 decreases to the substantially constant minimum value, the amount of current through pull-up resistor 152 increases up to a substantially constant value, at which point additional increases in magnitude of light at phototransistor 144 produce little or no increases in current $I_C$. As the current $I_C$ through phototransistor 144 increases, a greater voltage drop across pull-up resistor 152 is produced which results in a lower magnitude electrical signal $V_{OUT}$ at terminal 157. These occurrences are mathematically represented by Ohm's law:

$$\text{Voltage } (V_{OUT}) = V_{SOURCE} - (\text{Current } (I_C) \times \text{Resistance } (R_{PULL-UP})).$$

As can additionally be seen in FIG. 4, sheet of transparent print media 126 includes a substrate 127 having a first surface 156 shown facing source 90. Substrate 127 also includes a second surface (not shown) opposite of first surface 156 and facing sensor 92.

Figure 5:
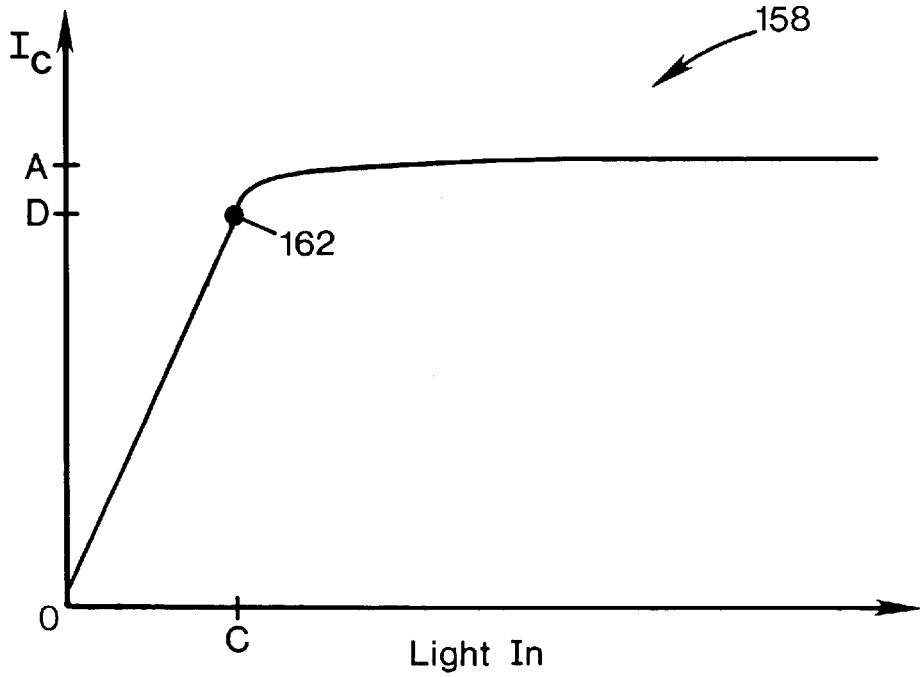
FIG. 5 is a diagram of a current output waveform through a sensor of the embodiment of the print media detector shown in FIGS. 1–4 versus light into the sensor.

A diagram 158 of the current output waveform through phototransistor 144 of sensor 92 ($I_C$) as the magnitude of light illuminating phototransistor 144 (Light In) changes is shown in FIG. 5. As can be seen in FIG. 5, $I_C$ increases as the amount of Light In increases, up to a substantially constant magnitude (A), at which point further increases in the magnitude of light at phototransistor 144 result in little or no increase in $I_C$.

Figure 6:
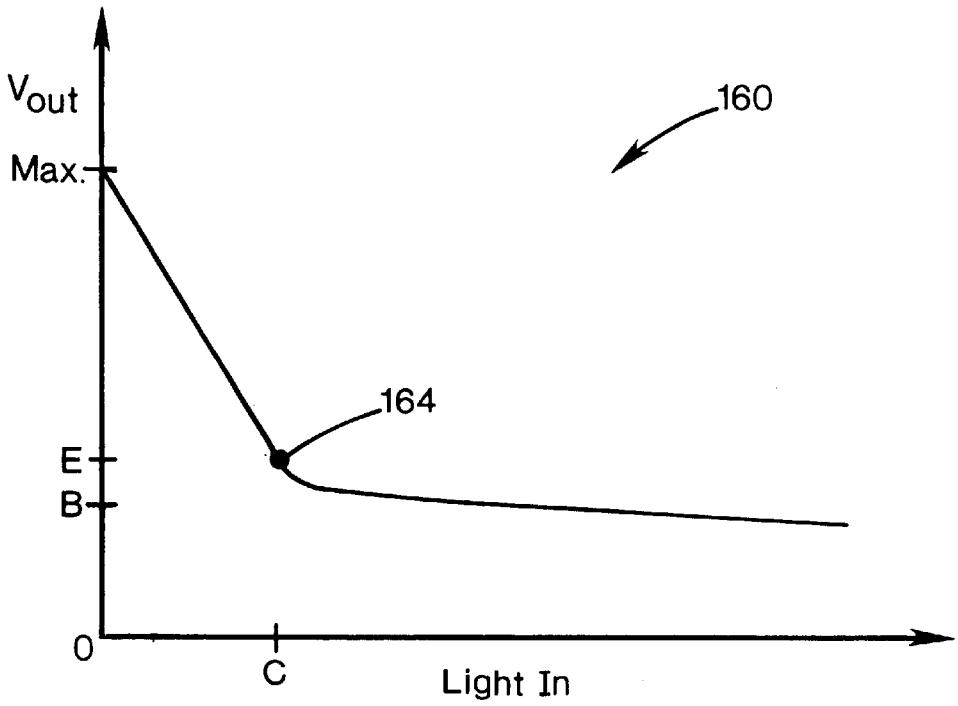
FIG. 6 is a diagram of a voltage output waveform at the sensor of the embodiment of the print media detector shown in FIGS. 1–4 versus light into the sensor.

A diagram 160 of the voltage output waveform at terminal 157 of phototransistor 144 of sensor 92 ($V_{OUT}$) as the magnitude of light illuminating phototransistor 144 (Light In) changes is shown in FIG. 6. As can be seen in FIG. 6, $V_{OUT}$ is at a maximum value (Max.) until light illuminates phototransistor 144. Once light is present at base 147 of phototransistor 144, $V_{OUT}$ decreases as the amount of Light In increases to a substantially constant magnitude (B), at which point further increases in the magnitude of light at phototransistor 144 result in little or no decrease in $V_{OUT}$.

The print media detector and method of the present invention take advantage of these properties of phototransistor 144 to detect transparent and nontransparent print medium. This is accomplished by selecting a value for the light signal 142 output of source 128 with no print media present which is of sufficient magnitude to cause phototransistor 144 to operate near the point at which the current $I_C$ reaches a substantially constant value, such as point 162 in FIG. 5. This magnitude for light signal 142 is shown as having a value substantially equal to the value (C) for (Light In) in FIG. 5.

In operation of the present invention, a sheet of print media, such as transparent print media sheet 126, is "picked" by print media feed rollers 96 and transported to printzone 25, as generally indicated by arrow 174 in FIG. 4. As sheet 126 passes between source 90 and sensor 92, switch 138 of source 90 is closed so that current is conducted to ground 132 through LED 128 which produces light signal 142 having a magnitude substantially equal to the value of (C), as discussed above. In the case of transparent sheet of print media 126, light signal 142 passes through substrate 127 substantially unattenuated and triggers phototransistor 144 to conduct, producing a current $I_C$ in phototransistor 144 having a magnitude (D) at point 162 on diagram 158. This current $I_C$ in turn produces a voltage ($V_{OUT}$) at terminal 157 having a magnitude (E) at point 164 on diagram 160. Controller 40 is configured to interpret this value of $V_{OUT}$ as indicating that a transparent sheet of print media has been picked. Controller 40 is additionally configured to control one or more operating parameters of printing device 20 based upon this value of $V_{OUT}$. Once sheet 126 passes though print media detector 86, switch 138 is opened so that LED 128 no longer produces light signal 142.

Figure 7:
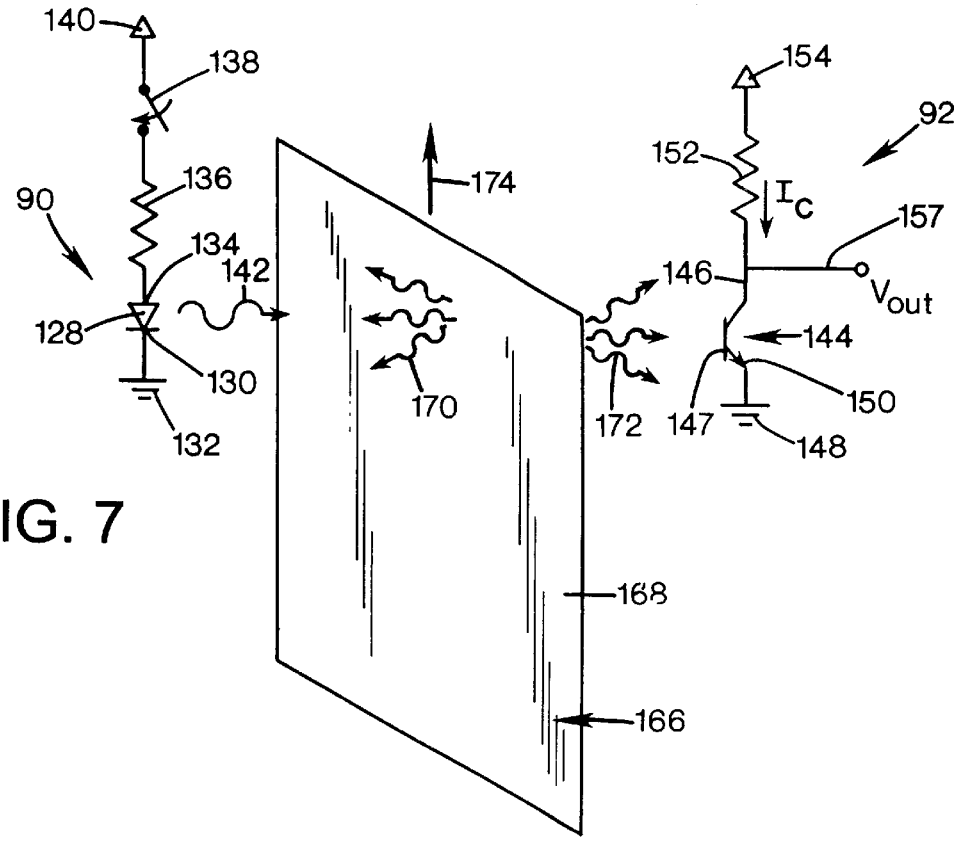
FIG. 7 is a schematic diagram of a print media detector of the present invention in use with a sheet of nontransparent print media.

A schematic diagram of a print media detector of the present invention in use with a sheet of nontransparent print media is shown in FIG. 7. Where possible, the same reference numerals are used in FIG. 7 as those used in FIG. 4. In operation of the present invention, a sheet of nontransparent print media is "picked" by print media feed rollers 96 and transported to printzone 25, as generally indicated by arrow 174 in FIG. 4. As sheet 166 passes between source 90 and sensor 92, switch 138 of source 90 is closed so that current is conducted to ground 132 through LED 128 which produces light signal 142 having a magnitude substantially equal to the value of (C), as discussed above. In the case of nontransparent sheet of print media 166, as light signal 142 encounters substrate 168 of sheet 166, a first portion 170 is diffused and reflected back toward source 90 and a second portion 172 is diffused and attenuated as it passes through substrate 168. This lower magnitude second portion 172 triggers phototransistor 144 to conduct, producing a current $I_C$ in phototransistor 144 having a magnitude less than value (D) at point 162 on diagram 158. This lower current $I_C$ in turn produces a voltage ($V_{OUT}$) at terminal 157 having a magnitude greater than value (E) at point 164 on diagram 160. Controller 40 is configured to interpret this higher voltage value of $V_{OUT}$ as indicating that a nontransparent sheet of print media has been picked. Controller 40 is additionally configured to control one or more operating parameters of printing device 20 based upon this value of $V_{OUT}$. Once sheet 166 passes though print media detector 86, switch 138 is opened so that LED 128 no longer produces light signal 142

As discussed above, source 90 includes an LED 128. In one or more embodiments of the present invention, LED 128 may be a focused LED. The use of a focused LED has been found to help prevent some lightweight nontransparent print media from being detected as transparent print media. Transparent print media diffuse little if any of the light signal 142 from a focused LED. Lightweight nontransparent print media, on the other hand, do diffuse the focused light signal 142 which lessens the amount of light that reaches phototransistor 144 producing a lower magnitude value for $I_C$ and a resulting greater magnitude value for $V_{OUT}$, thus further enhancing differentiation between transparent and nontransparent print media.

Thus, the present invention automatically detects the presence of either a transparent or nontransparent print media used in printing devices to help optimize output print quality of printing device 20. The present invention also saves user time and money by eliminating time-consuming and expensive trial and errors to obtain such output print quality. The present invention accomplishes this without degrading output print quality of the printing device.

Although the invention has been described and illustrated in detail, it is to be clearly understood that the same is intended by way of illustration and example only, and is not to be taken necessarily, unless otherwise stated, as an express limitation. For example, although print media detector 86 is shown attached to sidewall 88 or print media handing system 26, other locations are possible. As an example, in alternative embodiments of the present invention, print media detector 86 may be located on input supply feed tray 28 or any other additional input supply tray. The spirit and scope of the present invention are to be limited only by the terms of the following claims.

What is claimed is:

1. A print media detection system for use in a printing device, the print media detection system comprising:

means for transmitting a light signal;

means for sensing the light signal and producing an electrical signal having a first magnitude for a transparent print media through which the light signal travels and a second magnitude less than the first magnitude for nontransparent print media positioned in a path of the light signal from the source to the sensor; and focus means incorporated into the means for transmitting light for ensuring that lightweight media is sensed as nontransparent print media, wherein lightweight media is media that, in the absence of the focus means, would not substantially attenuate the light.

2. The print media detection system of claim 1, further comprising means coupled to the means for sensing for controlling an operating parameter of the printing device based at least in part on the electrical signal received from the means for sensing.

3. The print media detection system of claim 1, wherein the focus means includes a focused light emitting diode.

4. The print media detection system of claim 1, wherein the means for sensing includes a phototransistor.

5. The print media detection system of claim 1, in a printing device.

6. A method of detecting transparent and nontransparent print media for use in a printing device, the method comprising:

transmitting a light signal toward a sheet of print media;

controlling the light signal so that it is substantially attenuated by lightweight media that has a transparence characteristic that is between nontransparent print media and transparent print media;

measuring an intensity of light at a sensor positioned along a path of the light signal, the sheet of print media being positioned between the light signal and the sensor;

generating one of an electrical signal having a first magnitude for a measured intensity of light substantially equal to an intensity of the light signal and an electrical signal having a second magnitude less than the first magnitude for a measured intensity of light less than the intensity of the light signal.

7. The method of claim 6, further comprising controlling an operating parameter of the printing device based at least in part on the electrical signal.

* * * * *